US009993837B2

(12) United States Patent
Ullett

(10) Patent No.: US 9,993,837 B2
(45) Date of Patent: Jun. 12, 2018

(54) NOZZLE FOR SEALANT APPLICATOR HAVING APPLICATION ENHANCING FORMATION

(71) Applicant: United States Gypsum Company, Chicago, IL (US)

(72) Inventor: James M. Ullett, McHenry, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 18 days.

(21) Appl. No.: 14/804,875

(22) Filed: Jul. 21, 2015

(65) Prior Publication Data

US 2016/0214121 A1 Jul. 28, 2016

Related U.S. Application Data

(60) Provisional application No. 62/107,756, filed on Jan. 26, 2015.

(51) Int. Cl.
*B05C 17/00* (2006.01)
*B05C 17/005* (2006.01)
*B05C 17/01* (2006.01)

(52) U.S. Cl.
CPC .... *B05C 17/00516* (2013.01); *B05C 17/0123* (2013.01); *B05C 17/00513* (2013.01); *B05C 17/00583* (2013.01)

(58) Field of Classification Search
CPC ..... B05C 17/00516; B05C 17/0254; B05C 17/00503; B05B 1/267; B05B 15/069; B05B 1/042; B05B 1/04; B05B 1/044; B65D 88/28
USPC ..... 239/601, 598, 592–594, 597, 521, 522, 239/524, 517; 222/566–568, 571, 575
See application file for complete search history.

(56) References Cited

U.S. PATENT DOCUMENTS 2,754,033 A * 7/1956 Etter ..... B41L 27/02 222/326
2,804,767 A * 9/1957 Schoen ..... B05C 17/00516 111/7.1
3,087,654 A * 4/1963 Moore ..... E04F 21/04 222/105
4,570,834 A * 2/1986 Ward ..... B05C 17/00516 222/566

(Continued)

FOREIGN PATENT DOCUMENTS

| | | |
|---|---|---|
| DE | 102013102021 | 8/2014 |
| GB | 2487778 | 8/2012 |
| WO | 2012150471 | 11/2012 |

OTHER PUBLICATIONS

International Search Report from International Patent Application No. PCT/US2016/013129, dated Apr. 1, 2016.

*Primary Examiner* — Christopher Kim
*Assistant Examiner* — Tuongminh Pham
(74) *Attorney, Agent, or Firm* — Greer, Burns & Crain, Ltd.; Pradip Sahu; Philip T. Petti

(57) ABSTRACT

A nozzle is provided configured for applying sealant to a construction panel joint. The nozzle includes a nozzle body having a first, supply end, and a second, outlet end opposite the supply end, the body defining an internal passageway. Also included on the nozzle is at least one tooling formation located at the outlet end and constructed and arranged for tooling a bead of sealant dispensed out the passageway from the outlet end.

14 Claims, 6 Drawing Sheets

(56) References Cited

U.S. PATENT DOCUMENTS

| | | | | | |
|---|---|---|---|---|---|
| 4,946,081 | A | * | 8/1990 | Jacobson | B05C 17/00516 222/568 |
| D310,635 | S | * | 9/1990 | Schultz | B05C 17/00516 D9/447 |
| 5,000,361 | A | * | 3/1991 | Briddell | B05C 17/00516 222/575 |
| 5,017,113 | A | * | 5/1991 | Heaton | B05C 17/00516 222/327 |
| 5,415,488 | A | * | 5/1995 | MacGibbon | B65D 83/285 401/139 |
| 5,605,259 | A | * | 2/1997 | Clawson | B65D 83/285 222/192 |
| 5,695,788 | A | * | 12/1997 | Woods | E04F 21/08 15/235.7 |
| 5,749,498 | A | * | 5/1998 | Lavoie | B05C 17/00516 222/192 |
| 6,422,777 | B1 | * | 7/2002 | Landrau | B05C 17/00516 222/566 |
| 2010/0278958 | A1 | | 11/2010 | Chamberlain et al. | |

* cited by examiner

NOZZLE FOR SEALANT APPLICATOR HAVING APPLICATION ENHANCING FORMATION

RELATED APPLICATION

This application claims priority under 35 USC 119(e) from U.S. Provisional Application Ser. No. 62/107,756 filed Jan. 26, 2015.

BACKGROUND

The present invention relates generally to devices for applying liquid sealants to joints, and more specifically to a nozzle constructed and arranged for applying sealant between abutting exterior construction panels.

Conventional building techniques include the use of weather-resistant construction panels secured to a wood or metal frame, and then covered with an exterior finish cladding. Such panels, an example of which is SECUROCK® exterior building panels, typically incorporate cement, fiberglass or other durable material surrounding a gypsum core, and are used under exterior claddings where conventional gypsum sheathing products have traditionally been installed, such as brick veneer, Exterior Insulation Finish Systems (EFIS), clapboard siding, panel siding, shingle siding, shake siding and conventional stucco, among other construction styles. Once installed, all of the joints between abutting panels need to be sealed to provide continuity of the barriers, and to provide a water and air-resistant barrier.

During conventional construction techniques, the sealant, typically silicone or polyurethane is applied to the joints. The sealant is roughly applied in a round bead over the joint, then is tooled by the applicator to provide an approximate 1.5-inch min. width joint. Next, the edges are tooled to remove the potential for water to pool or pond on top and work its way into the system under pressure. Conventional nozzles are provided that will meter a width of sealant, but still require the applicator to tool the product as desired. There is a need in the industry for a nozzle which facilitates application of the sealant in a way that reduces required follow-up labor.

SUMMARY

The above-listed needs are met or exceeded by the present sealant applicator nozzle, which dispenses liquid sealant, meters the amount applied to a joint, as well as tooling the edges and including a guide tab for maintaining alignment with the joint during application. The present nozzle configuration includes an outlet configured for metering the width and depth of the sealant being applied to the assembly. Tooling wings projecting laterally from the nozzle outlet provide a finished edge that reduces the need for additional hand tooling and reduces variability based on the level of craftsmanship of the applicator. In addition, a centering fin helps align the nozzle on the center of the joint. In one embodiment, a two-piece nozzle is contemplated, that is compatible with conventional bulk and sausage-loading caulk guns. In the two-piece format, a base portion is removable from a main nozzle body and permits installation of a collar on the nozzle before the base is attached. The collar is used to secure the nozzle to the caulking gun. The nozzle is a disposable item, and is preferably made of plastic by injection molding.

More specifically, the present invention provides a nozzle configured for applying sealant to a construction panel joint.

The nozzle includes a nozzle body having a first, supply end, and a second, outlet end opposite the supply end, the body defining an internal passageway. Also included on the nozzle is at least one tooling formation located at the outlet end and is constructed and arranged for tooling a bead of sealant dispensed out the passageway from the outlet end.

In another embodiment, a nozzle is provided that is configured for use with a caulking gun in applying sealant to a construction panel joint. The nozzle includes a nozzle body having a first, supply end, and a second, outlet end opposite the supply end, the body defining an internal passageway. At least one tooling formation is located at the outlet end and is constructed and arranged for tooling a bead of sealant dispensed from the outlet end. The outlet end includes a pair of generally parallel long edges, and the at least one tooling formation is a wing projecting from an associated end of one of the long edges. A locating tab is disposed adjacent an opposite one of the long edges. In addition, a metering recess is formed in the long edge opposite the tab.

DETAILED DESCRIPTION

Figure 1:
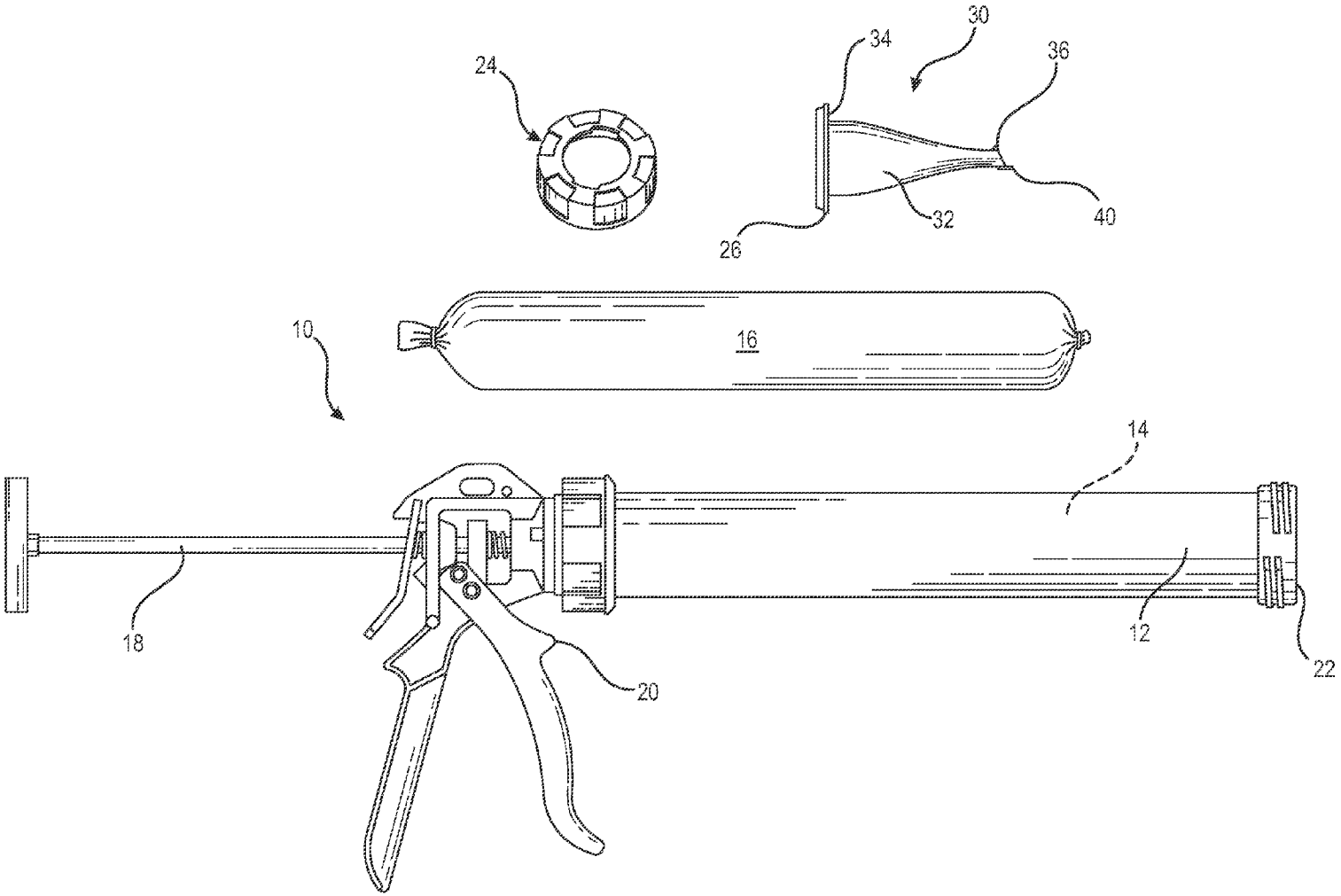
FIG. 1 is an exploded side view of a caulk gun, sealant sausage package, collar and the present nozzle.

Referring now to FIG. 1, an industrial caulking gun is generally designated 10, and includes a barrel 12 defining a chamber 14 (shown hidden) for accommodating a container of sealant 16, known in the industry as a "sausage." A piston rod 18 attached at one end to a piston (not shown) is retracted by the operator relative to the barrel 12 to clear the chamber 14 for placement of the sausage 16. A ratchet type trigger mechanism 20 incrementally advances the piston and piston rod 18 towards an outlet 22 of the barrel, thus pressurizing the sausage 16 so that a bead of the sealant is emitted from the outlet. As is known in the art, the outlet 22 is externally threaded for accommodating a threaded collar 24 which captures a radially extending flange 26 of the present nozzle, generally designated 30.

Figure 2:
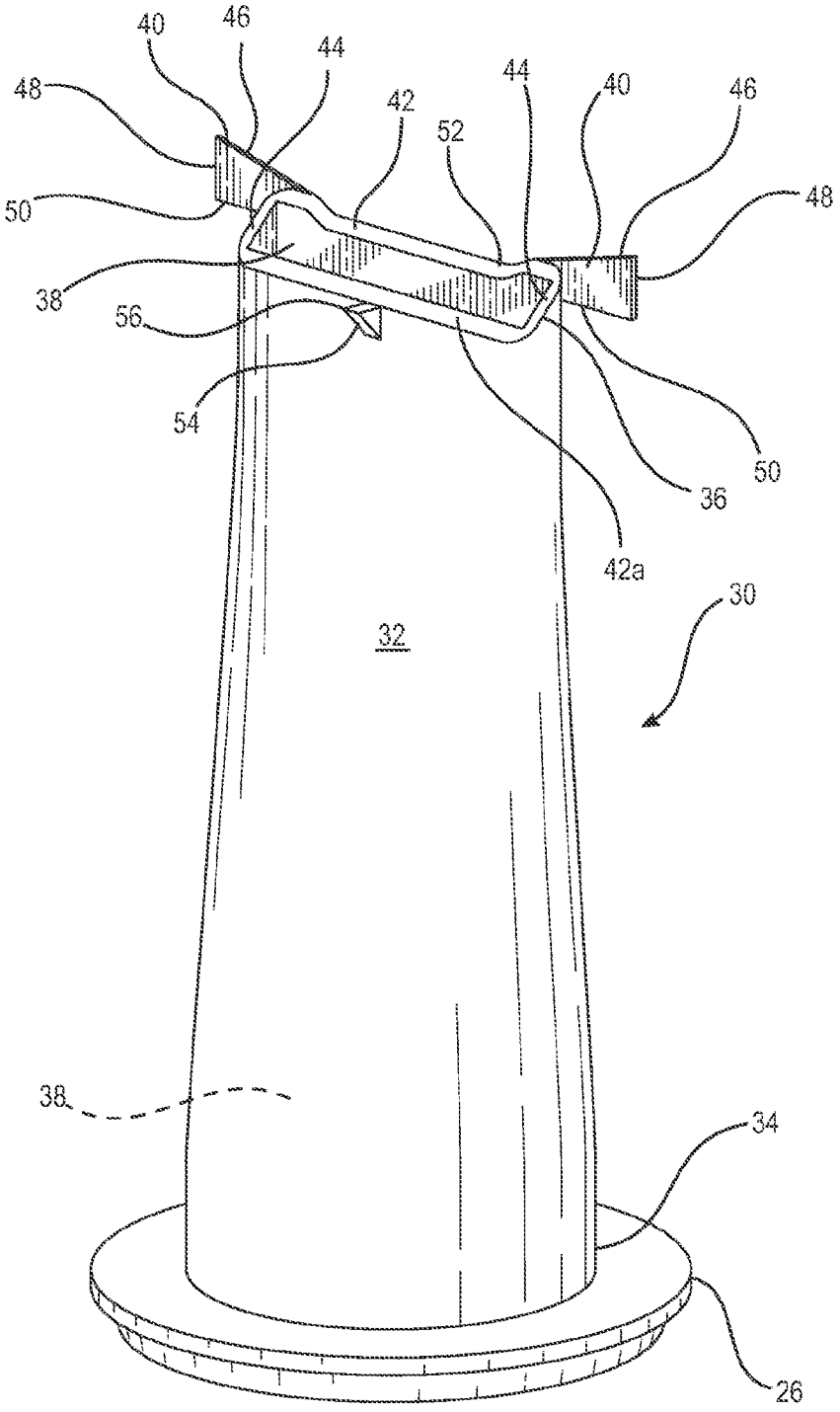
FIG. 2 is a perspective view of the present nozzle.
Figure 3:
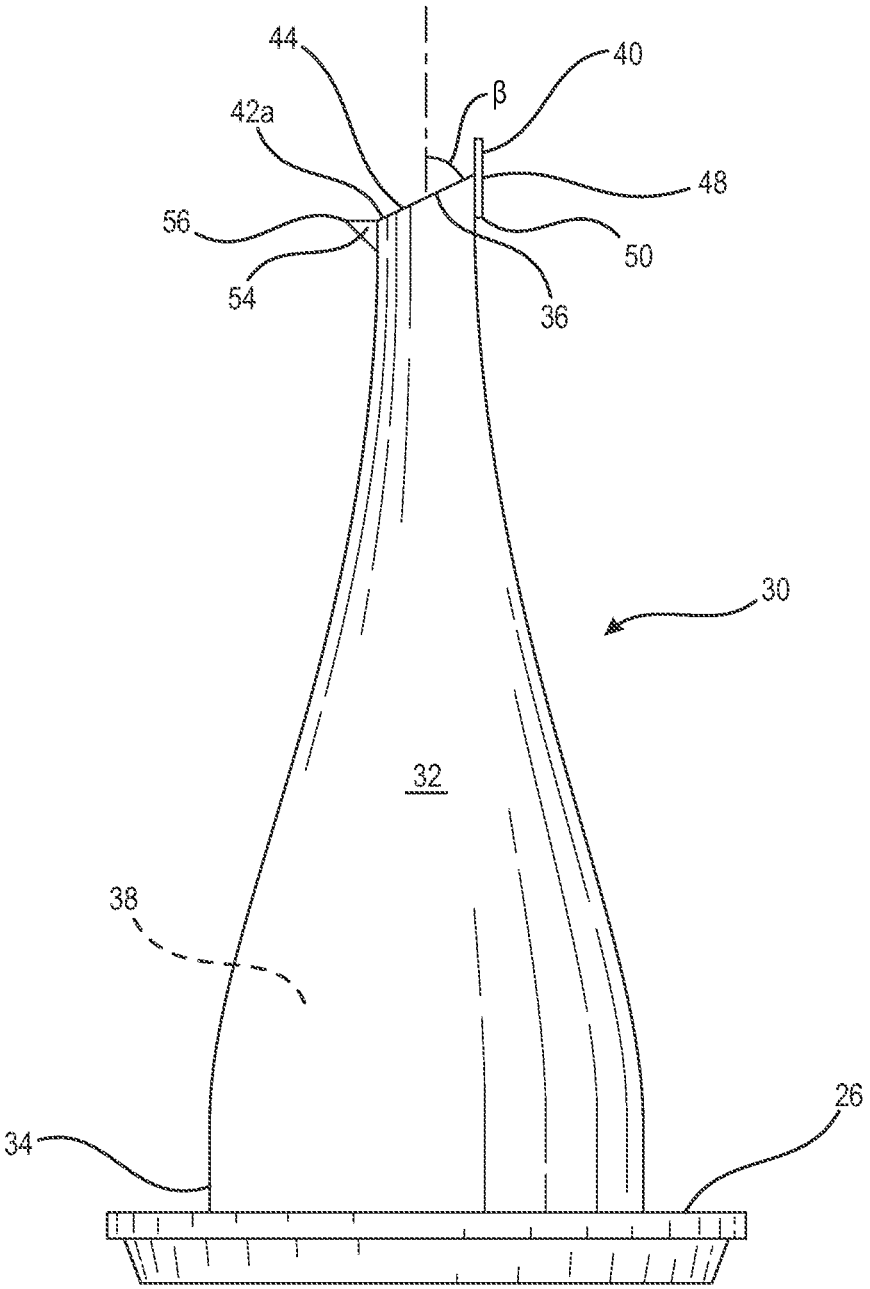
FIG. 3 is a side view of the present nozzle.

Referring now to FIGS. 2 and 3, the present nozzle 30 features at least one formation for tooling the sealant as it is emitted from the barrel outlet 22 so that a suitable crowned bead is formed in the joint between abutting construction panels, as described in greater detail below. Conventional nozzles emit the bead in a way which requires additional manual tooling by the operator.

Included on the present nozzle 30 is a nozzle body 32 having a first, supply end 34 receiving caulk from the barrel outlet 22, and a second, outlet end 36 opposite the supply end. An internal passageway 38 is formed by the body 32 and connects the ends 34, 36. At least one tooling formation 40 is located at the outlet end 36 and is constructed and arranged for tooling a bead of sealant dispensed out the passageway 38 from the outlet end. In the preferred embodiment, the at least one tooling formation 40 is at least one and preferably a pair of wings projecting laterally from the nozzle body 32 at the outlet end 36.

More specifically, the outlet end 36 is defined by a pair of generally parallel long edges 42, and a pair of generally parallel short edges 44 that together define a rectangular shape. The wings 40, which are preferably integrally molded with the nozzle 30 or otherwise attached as by chemical adhesive or the like, are disposed in a plane generally parallel to an adjacent one of the long edges 42. The wings 40 are constructed and arranged to be relatively stiff to be able to tool the sealant, but at the same time flexible in a direction opposite the direction of movement of the nozzle 30 (FIG. 5) as it applies the sealant to the joint, described below. In addition, each wing 40 is generally planar and has an angled trailing or working edge 46 defining an acute angle θ (FIG. 6) relative to the corresponding outlet edge 42. The remaining edges 48, 50 of the wing 40 form a right angle. The long wing edge 50 is generally parallel to the long nozzle outlet edge 42.

Another feature of the present nozzle 30 is that the long nozzle outlet edge 42 that is associated with the wings 40 is also provided with a metering recess 52. As the nozzle 30 and the attached caulking gun 10 are inclined relative to the board joint for application of the sealant, the metering recess 52 defines a restricted outlet for the sealant as the nozzle is dragged along the joint. Thus, the metering recess 52 is located between the wings 40 in a direction transverse to a longitudinal axis of the nozzle body 32.

Referring now to FIG. 3, to facilitate the even dispensation of sealant from the nozzle 30, the short edges 44 are disposed at an angle β relative to the longitudinal axis of the body such that the long edge 42 with the metering recess 52 extends farther from the first end 34 than the opposite long edge 42*a*. In the preferred embodiment, the angle β is 45°, however other angles are contemplated. Thus, the sealant is emitted from the nozzle outlet end 36 and the flow is restricted out the metering recess 52.

Another feature of the present nozzle 30 is a guide tab 54 disposed at the nozzle outlet end 36 for following the joint as the nozzle 30 applies the sealant in an application direction. The tab 54 is located upstream of the application of the sealant, and projects from one of the long edges 42, specifically the edge 42*a* opposite the edge with the wings 40 and the metering recess 52. While other shapes are contemplated, the tab 54 is generally triangular-shaped, with a pointed end 56 extending perpendicularly from the nozzle body 32, and also from the longitudinal axis of the body. The tab 54 is constructed and arranged to follow the joint between adjacent construction panels, so that the bead of sealant applied to the joint follows the joint evenly.

Referring again to FIG. 2, the nozzle body 32 generally tapers from a relatively large volume inlet at the first or supply end 34 to a generally small volume outlet at the outlet end 36. This configuration helps pressurize the sealant so that an even stream or bead of sealant is emitted from the metering recess 52.

Figure 4:
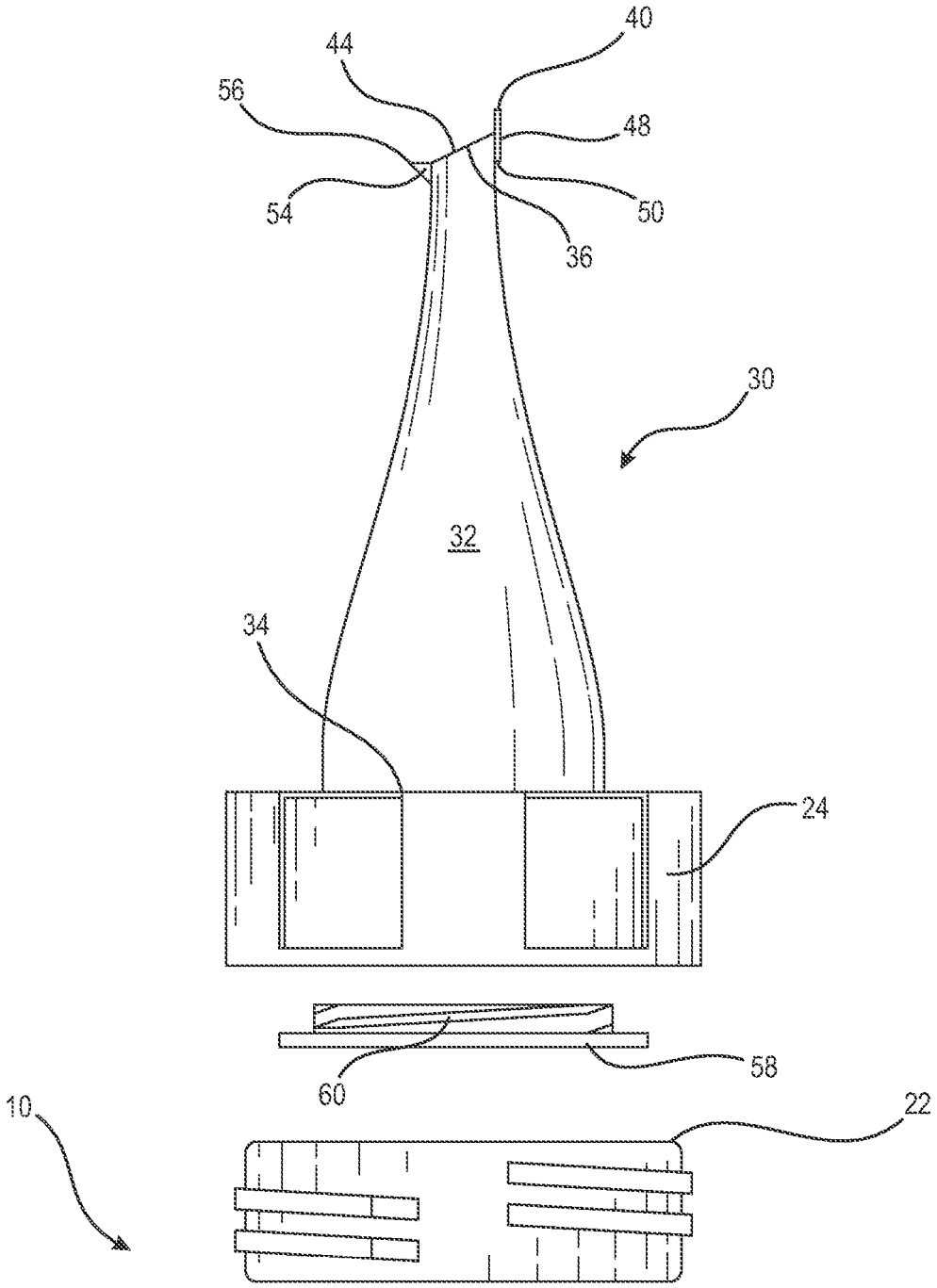
FIG. 4 is a side view of the present nozzle with the present base unthreaded and exploded away, and the collar shown mounted on the nozzle.

Referring now to FIG. 4, in a preferred embodiment, the nozzle 30 is provided in two pieces, with a flange 58 having a threaded nipple 60 threadably engaging the supply end 34. An advantage of this construction is that the collar 24 may be placed around the body at the supply end 34 for facilitating threaded engagement between the collar 24 and the barrel outlet 22. The collar 24 captures the flange 58 and retains it against the barrel outlet 22.

Figure 5:
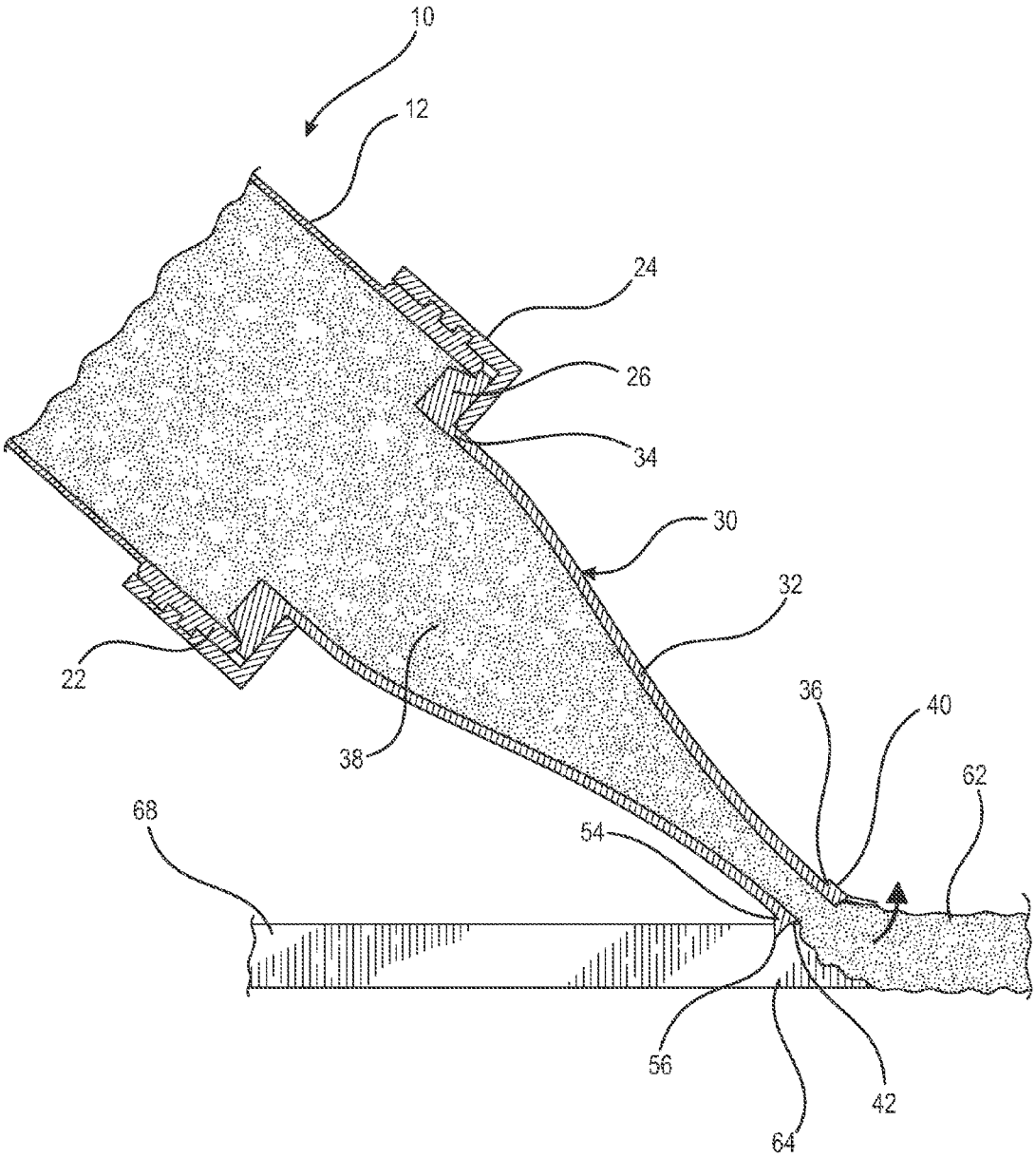
FIG. 5 is a vertical sectional view showing the present nozzle applying sealant to a joint between boards.
Figure 6:
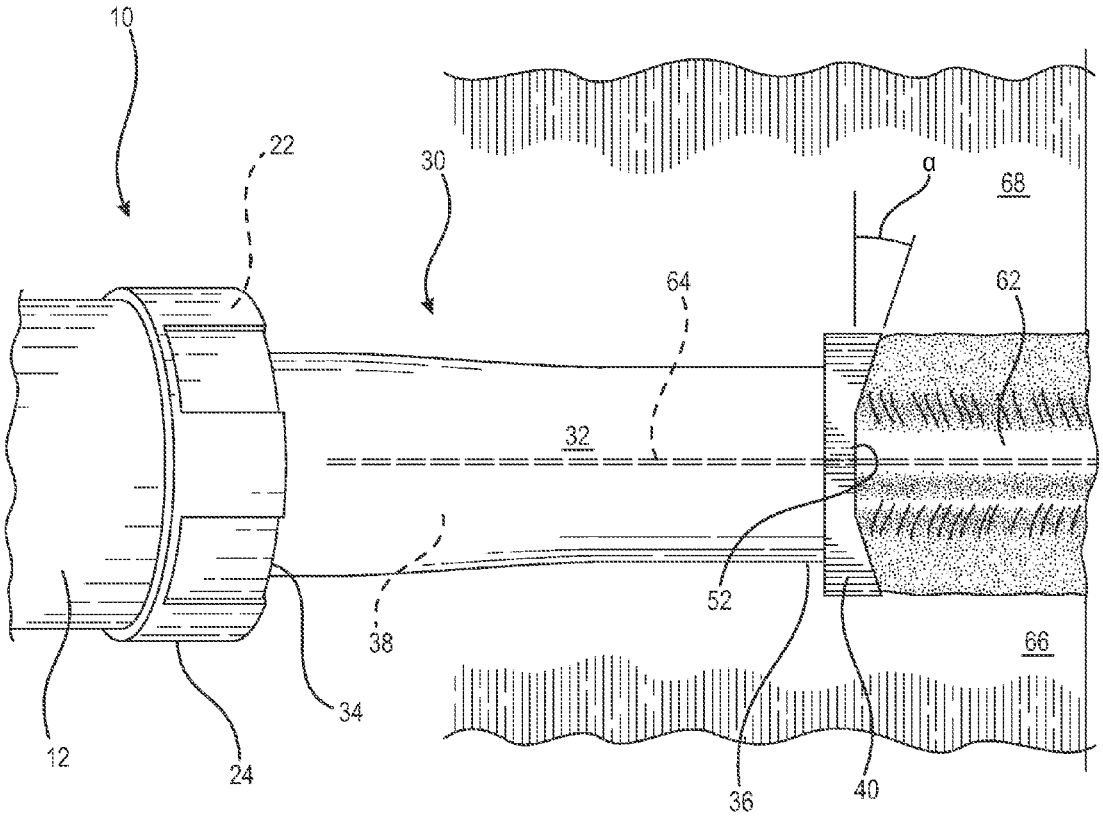
FIG. 6, top view of FIG. 5, showing the nozzle emitting the crowned shape of the sealant to provide a watertight joint.

Referring now to FIGS. 5 and 6, the present nozzle 30 is shown in operation, applying a bead of sealant 62 to a joint 64 between adjacent construction panels 66, 68. It will be seen how the guide tab 54 follows the joint 64, and the sealant 62 is formed or tooled by the wings 40 located downstream of the tab.

While a particular embodiment of the present nozzle for sealant applicator having application enhancing formations has been described herein, it will be appreciated by those skilled in the art that changes and modifications may be made thereto without departing from the invention in its broader aspects and as set forth in the following claims.

The invention claimed is:

1. A nozzle configured for applying sealant to a construction panel joint, comprising:

a nozzle body defining an internal passageway having a first, supply end, and a second, outlet end opposite said supply end, said outlet end defined by a pair of generally parallel long edges and a pair of generally parallel short edges, at said outlet end, said passageway being contiguous with said pair of generally parallel long edges and said pair of generally parallel short edges;

at least one tooling formation located at said outlet end and constructed and arranged for tooling a bead of sealant dispensed out said passageway from said outlet end and said sealant contacting both said long edges and both said short edges as it is dispensed, wherein said at least one tooling formation is a pair of planar wings formed by ends of a strip disposed along only one of said long edges, each said wing projecting laterally beyond and perpendicular to said short edges when viewed from a position opposite said outlet end, each said wing projecting away from said one long edge defining said outlet end; and one of said long edges is provided with a metering recess so that a distance between said long edges at said recess is less than a distance between said long edges outside said recess, wherein said recess has a substantially horizontal base a distance less than an opposite long edge.

2. The nozzle of claim 1 wherein said pair of wings are disposed in a plane generally parallel to an adjacent one of said long edges.

3. The nozzle of claim 1 wherein each said planar wing is opposite a side closest to the construction panel joint, and said wing having an angled trailing edge defining an acute angle relative to a corresponding outlet edge, where said trailing edge extends laterally from the construction panel joint and said acute angle extends downstream of said outlet edge.

4. The nozzle of claim 3 wherein each said wing is constructed and arranged to flex in a direction opposite to a direction of application of the sealant.

5. The nozzle of claim 1, wherein said pair of tooling wings are located adjacent to but separate from said metering recess.

6. The nozzle of claim 1, wherein said short edges are disposed at an angle relative to an axis of said body such that said long edge with said metering recess extends farther from said first end than said opposite long edge.

7. The nozzle of claim 1 further including a guide tab disposed at said outlet end for following the joint as said nozzle applies the sealant in an application direction, the tab located upstream of the application of the sealant.

8. The nozzle of claim 7, wherein said at least one tooling formation projects from one of said long edges and said tab is disposed adjacent an opposite one of said edges.

9. The nozzle of claim 8, wherein said metering recess is located in said long edge opposite said tab.

10. The nozzle of claim 1 wherein said body generally tapers from a relatively large volume inlet at said first end to a generally small volume outlet at said outlet end.

11. The nozzle of claim 1, further including a base with a flange releasably fastened to said first end.

12. A nozzle configured for use with a caulking gun in applying sealant to a construction panel joint, comprising:

a nozzle body having a first, supply end, and a second, outlet end opposite said supply end, said body defining an internal passageway;

at least one tooling formation located at said outlet end and constructed and arranged for tooling a bead of sealant dispensed from said outlet end;

said outlet end includes a pair of generally parallel long edges and a pair of generally parallel short edges, at said outlet end, said passageway being contiguous with said pair of generally parallel long edges and said pair of generally parallel short edges, and said at least one tooling formation is a pair of wings, formed by ends of a strip disposed along only one of said long edges, projecting from an associated end of one of said long edges laterally beyond and perpendicular to said short edges when viewed from a position opposite said outlet end, for tooling a bead of sealant dispensed out said passageway from said outlet end and contacting both said long edges and both said short edges;

a locating tab is disposed adjacent an opposite one of said long edges; and a metering recess is formed in said long edge opposite said tab so that a distance between said long edges at said recess is less than a distance between said long edges outside said recess.

13. The nozzle of claim 12 wherein said at least one wing is planar and has an angled trailing edge defining an acute angle relative to a corresponding outlet edge.

14. The nozzle of claim 12, wherein each said wing has a working edge defining an acute angle relative to said metering recess, which is formed in said associated long edge so that a resulting bead of sealant is tooled at edges of the bead of sealant.

* * * * *